US008257207B2

(12) United States Patent
Verrengia et al.

(10) Patent No.: US 8,257,207 B2
(45) Date of Patent: Sep. 4, 2012

(54) BASEBALL BAT HAVING ARTIFICIALLY FIBER-FUSED CORE AND METHOD OF MANUFACTURING THE SAME

(75) Inventors: Thomas M. Verrengia, Staten Island, NY (US); Lilian Bao, Fujian (CN); Yanshen Hsu, Staten Island, NY (US)

(73) Assignee: Pinnacle Sports Equipment Co., Inc., Staten Island, NY (US)

( * ) Notice: Subject to any disclaimer, the term of this patent is extended or adjusted under 35 U.S.C. 154(b) by 0 days.

(21) Appl. No.: 12/824,634

(22) Filed: Jun. 28, 2010

(65) Prior Publication Data

US 2010/0323831 A1 Dec. 23, 2010

Related U.S. Application Data

(62) Division of application No. 12/265,278, filed on Nov. 5, 2008, now Pat. No. 7,771,296.

(51) Int. Cl.
*A63B 59/06* (2006.01)

(52) U.S. Cl. ..... 473/564

(58) Field of Classification Search ..... 473/457, 473/519, 520, 564–568; 264/109–128; 156/296
See application file for complete search history.

(56) References Cited

U.S. PATENT DOCUMENTS 1,549,803 A * 8/1925 Rastetter ..... 473/564
2,458,919 A * 1/1949 Marsden ..... 473/564
5,476,706 A * 12/1995 Shimizu ..... 428/136
5,743,809 A * 4/1998 Lehman ..... 473/300
6,007,440 A * 12/1999 Bender et al. ..... 473/564
6,010,417 A * 1/2000 Young et al. ..... 473/564
6,086,804 A * 7/2000 Akiyama et al. ..... 264/115
6,334,823 B1 * 1/2002 Holman ..... 473/564
6,827,659 B1 * 12/2004 Chen ..... 473/564
7,052,419 B2 * 5/2006 Chang ..... 473/566
2003/0207098 A1 * 11/2003 Ryan ..... 428/297.4
2004/0266569 A1 * 12/2004 Davis et al. ..... 473/564
2005/0075201 A1 * 4/2005 Cullen et al. ..... 473/559
2005/0127567 A1 * 6/2005 DAvies ..... 264/322
2005/0161852 A1 * 7/2005 Decker et al. ..... 264/109
2006/0030437 A1 * 2/2006 Bao et al. ..... 473/564
2008/0023868 A1 * 1/2008 Slaven et al. ..... 264/109
2008/0176025 A1 * 7/2008 Xu ..... 428/106
2009/0130377 A1 * 5/2009 Samanta et al. ..... 428/113
2009/0250141 A1 * 10/2009 Wang ..... 144/333

* cited by examiner

*Primary Examiner* — Mark Graham
(74) *Attorney, Agent, or Firm* — Scully, Scott, Murphy & Presser, P.C.

(57) ABSTRACT

A baseball bat has a core section formed of wood fibers artificially fused together and an outer section substantially surrounding the core section. The core section can be made exclusively of bamboo fibers artificially fused together. The core section can be substantially square having opposite front and rear sides and opposite top and bottom sides. The outer section has opposite side subsections, adhered to the sides of the core section. The side subsections have material strips arranged substantially in a first direction. The outer section further has a top subsection and a bottom subsection, adhered to the top and bottom of the core section, respectively. The top and bottom subsection have material strips arranged substantially in a second direction. The first direction and the second direction can be perpendicular to each other.

12 Claims, 6 Drawing Sheets

BASEBALL BAT HAVING ARTIFICIALLY FIBER-FUSED CORE AND METHOD OF MANUFACTURING THE SAME

CROSS REFERENCE TO RELATED APPLICATION

The present application is a continuation application of U.S. Ser. No. 12/265,278, filed Nov. 5, 2008, the entire contents of which are incorporated herein by reference.

BACKGROUND

1. Field of the Invention

This disclosure relates generally to baseball bats and a method for manufacturing baseball bats, and more particularly, to baseball bats with cores thereof fabricated from wood fibers artificially fused together and a method for manufacturing baseball bats having fiber-fused cores.

2. Prior Art

FIGS. 1A and 1B illustrates a traditional technique for fabricating wood baseball bats. FIG. 1A illustrates a baseball bat blank 100 and FIG. 1B illustrates a sectional view of the blank 100 taken about line 1B-1B in FIG. 1A. The blank 100 includes of a plurality of wood strips 102, each of which is typically about 10 mm thick by 900 mm long. The wood strips 102 are glued together in the same direction (direction A) to form the blank 100, which is typically about 70 mm by 70 mm in cross-section. As shown in FIG. 1B, the strips 102 are typically adhered in a staggered pattern. The blank 100 is then processed to form a finished baseball bat.

According to the existing industry standard, a baseball bat is around 25 mm in diameter at the thinnest part thereof, where the baseball bat is prone to break during use. One reason leading to failure of the baseball bat is that the symmetricalness of the bat relative to the central axis of the bat is not satisfactory and, accordingly, the baseball bat is anisotropic in mechanical performance. Another reason is that the strength of the core section of the bat, which substantially runs through the entire length of the bat, is not satisfactory.

In addition, due to the intense market competition, manufacturers of wood baseball bats are offering warranties against breakage for a predetermined period of time, for example, 30 days. However, the current warranties cannot meet the expectations of the consumers.

Therefore, it is desirable to provide a wood baseball bat with improved symmetricalness relative to the central axis and an improved core, which is strong, solid and unified. Accordingly, warranties against breakage for a longer time can be offered to the consumers.

SUMMARY OF THE DISCLOSURE

Therefore it is an object of the present invention to provide a wood baseball bat, in particular, a bamboo baseball bat that overcomes the disadvantages of baseball bats of the prior art.

Accordingly, a baseball bat is provided. The baseball bat comprises a core section made of wood fibers artificially fused together, and an outer section substantially surrounding the core section. The core section can be made exclusively of bamboo fibers artificially fused together.

In a first configuration, the core section comprises a substantially square cross section having opposite front and rear sides and opposite top and bottom sides.

In another configuration, the outer section comprises a pair of side subsections adhered to the front and rear sides of the core blank respectively, each of the side subsections comprising a plurality of material strips adhered to each other and to the core section.

In another configuration, the outer section comprises a pair of top and bottom subsections adhered to the top and bottom sides of the core blank respectively, each of the top and bottom subsections comprising a plurality of material strips adhered to each other and to the core section.

In another configuration, the plurality of material strips of the side subsections are arranged in a first direction and the plurality of material strips of the top and bottom subsections are arranged in a second direction.

In yet another configuration, the first direction is substantially perpendicular to the second direction.

The core section can have a cross sectional dimension of about 20 mm by 20 mm.

Also provided is a method for fabricating a blank from which a baseball bat is fabricated. The method comprises constructing a core section and constructing an outer section substantially surrounding the core section. The core section is constructed through harvesting a plurality of elongated pieces of wood, removing the outer layer, such as epidermis or skin, from each of the plurality of elongated pieces of wood, cutting each of the plurality of elongated pieces of wood into a predetermined length, crushing each of the plurality of elongated pieces of wood into a plurality of wood fibers, fusing the wood fibers to form a solid core blank, and processing the core blank to have a substantially square cross section having opposite front and rear sides and opposite top and bottom sides. The wood includes but is not limited to bamboo.

The outer section is constructed through forming a pair of side subsections adhered to the front and rear sides of the core blank respectively and forming a pair of top and bottom subsections adhered to the top and bottom sides of the core blank respectively. Each of the top and bottom subsections comprises a plurality of material strips adhered to each other and to the core section and each of the side subsections comprises a plurality of material strips adhered to each other and to the core section.

For example, fusing the wood fibers to form a solid core blank comprises drying the wood fibers, immersing the dried wood fibers in an adhesive agent for a predetermined time, collecting the wood fibers coated with the adhesive agent, drying the coated wood fibers, heat-pressing the dried wood fibers to form a unitary core blank.

For example, drying the wood fibers comprises heating the wood fibers at 100 degrees Celsius to keep the moisture content of the wood fiber at about 10%.

For example, drying the coated wood fibers comprises heating the wood fibers at 50 degrees Celsius to keep the moisture content of the coated wood fiber at about 10-15%.

For example, forming a pair of side subsections comprises arranging the plurality of material strips of the side subsections in a first direction and forming a pair of top and bottom subsections comprises arranging the plurality of material strips of the top and bottom subsections in a second direction. For example, the first direction is substantially perpendicular to the second direction.

Still yet provided is a method for fabricating a baseball bat. The method comprises constructing a core section, constructing an outer section substantially surrounding the core section, bonding the outer section with the core section to form a baseball bat blank, and processing the baseball bat blank into a form of a baseball bat. The core section is constructed through harvesting a plurality of elongated pieces of wood, removing the outer layer, such as epidermis or skin, from each of the plurality of elongated pieces of wood, cutting each of the plurality of elongated pieces of wood into a predetermined length, fiberizing the plurality of elongated pieces of wood by crushing each of the plurality of elongated pieces of wood into a plurality of wood fibers, fusing the wood fibers to form a solid and unitary core blank, and processing the core blank to have a substantially square cross section having opposite front and rear sides and opposite top and bottom sides. The outer section is constructed through forming a pair of side subsections adhered to the front and rear sides of the core blank respectively and forming a pair of top and bottom subsections adhered to the top and bottom sides of the core blank respectively. Each of the top and bottom subsections comprises a plurality of material strips adhered to each other and to the core section and each of the side subsections comprises a plurality of material strips adhered to each other and to the core section. The outer section is bonded to the core section through adhering the pair of side subsections to the front and rear sides of the core blank respectively and adhering the pair of top and bottom subsections to the top and bottom sides of the core blank respectively. The wood includes but is not limited to bamboo.

For example, fusing the wood fibers to form a solid and unitary core blank comprises drying the wood fibers, immersing the dried wood fibers in an adhesive agent for a predetermined time, collecting the wood fibers coated with the adhesive agent, drying the coated wood fibers, heat-pressing the dried wood fibers to form a solid and unitary core blank.

For example, drying the wood fibers comprises drying the wood fibers at 100 degrees Celsius to keep the moisture content of the wood fiber at about 10%.

For example, drying the coated wood fibers comprises drying the wood fibers at 50 degrees Celsius to keep the moisture content of the coated wood fiber at about 10-15%.

For example, the side subsections and the top and bottom subsections are made of at least one of wood and bamboo.

For example, forming a pair of side subsections comprises arranging the plurality of material strips of the side subsections in a first direction and forming a pair of top and bottom subsections comprises arranging the plurality of material strips of the top and bottom subsections in a second direction. For example, the first direction is substantially perpendicular to the second direction.

According to the present invention, a wood baseball bat, such as a bamboo baseball bat, having a fiber-fused core exhibits much higher impact strength, i.e., at least approximately 30% higher than the existing market-accessible bamboo baseball bat. Thus, the wood baseball bats according to the present invention are less prone to breakage during use. As a result, manufacturers can offer warranties against breakage for a significantly longer time, such as one year, which is not currently available in the market.

BRIEF DESCRIPTION OF THE DRAWINGS

These and other features, aspects, and advantages of the apparatus and methods of the present invention will become better understood with regard to the following description, appended claims, and accompanying drawings where:

DETAILED DESCRIPTION OF THE EXEMPLARY EMBODIMENTS

Although this invention is applicable to numerous and various types of suitable woods for use in baseball bats, it has been found particularly useful in the environment of bamboo. Therefore, without limiting the applicability of the invention to bamboo, the invention will be described in such an environment. The present invention is therefore not intended to be limited to any particular baseball bat or baseball bat configuration described in the exemplary embodiments of the present invention.

Figure 1A:
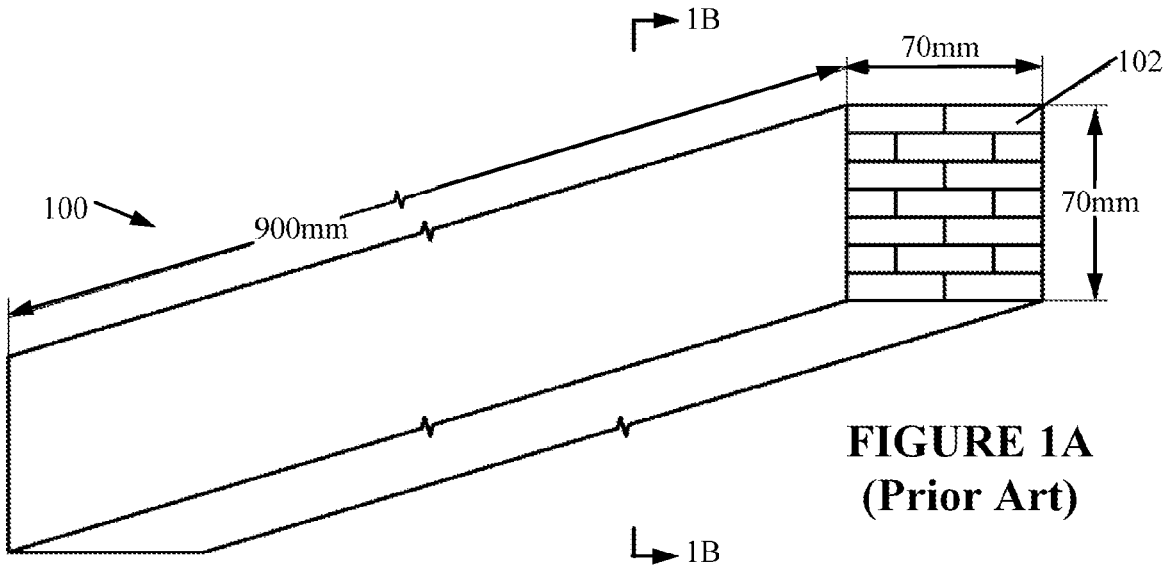
FIGURE 1A (Prior Art)
FIG. 1A illustrates an isometric view of a blank of the prior art from which a wood bat is fabricated.
Figure 1B:
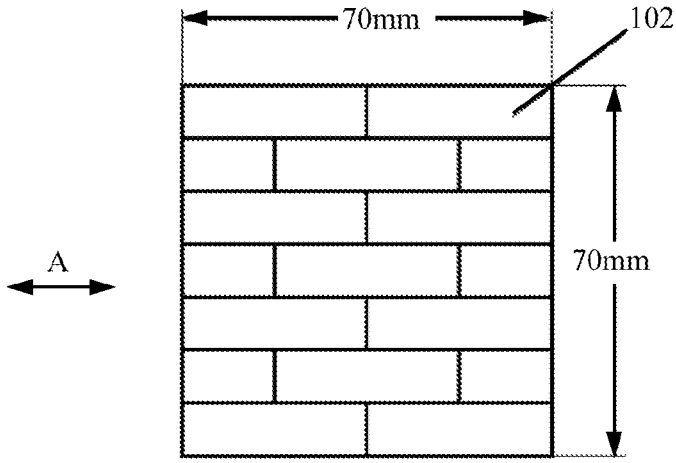
FIGURE 1B (Prior Art)
FIG. 1B is a sectional view of the blank of FIG. 1A as taken along line 1B-1B in FIG. 1A.
Figure 2A:
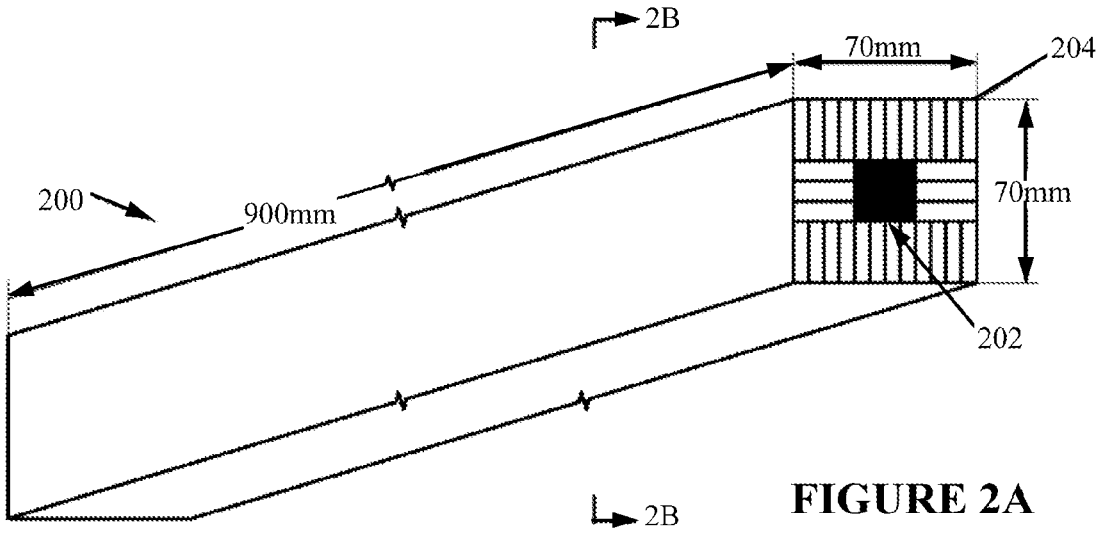
FIG. 2A is an isometric view of a blank from which a baseball bat is fabricated according to an exemplary embodiment according to the present invention.

Referring now to FIG. 2A, there is shown an exemplary embodiment of a blank from which is fabricated a baseball bat, the blank being referred to generally by reference numeral 200. The blank 200 having a core section 202, which is a unitary and solid core section made of wood fibers artificially fused together. For example, the core section 202 is made exclusively of bamboo fibers artificially fused together.

Figure 2B:
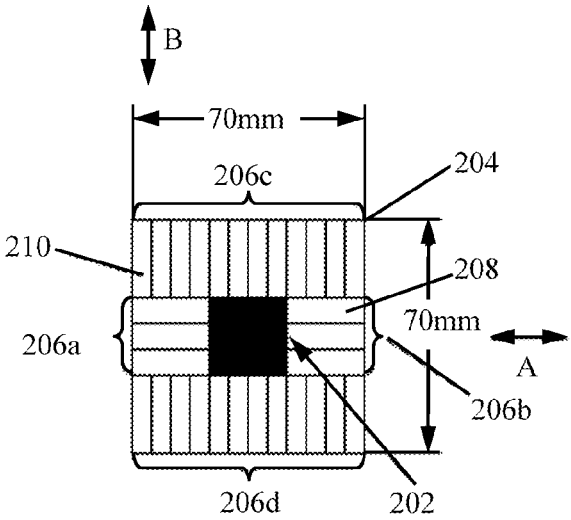
FIG. 2B is a sectional view of the blank of FIG. 2A as taken along line 2B-2B of FIG. 2A.
Figure 2C:
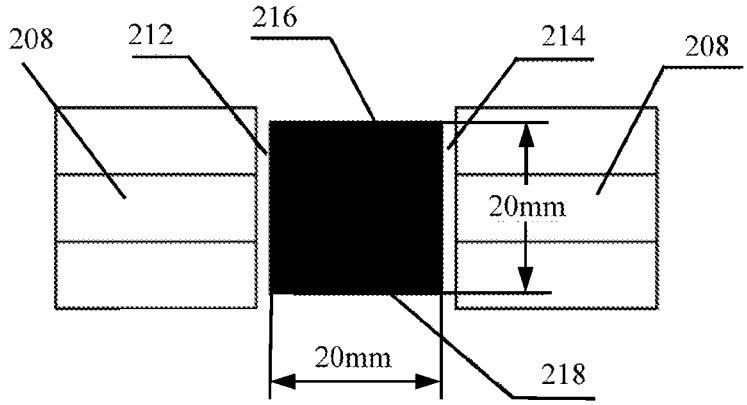
FIG. 2C is a detailed sectional view of a middle layer of the blank of FIGS. 2A and 2B.

Referring to FIG. 2C illustrating the middle layer of the blank 200, the core section 202 has substantially a square cross section including a pair of opposite front side 212 and rear side 214, and a pair of opposite top side 216 and bottom side 218. The core section 202 is manufactured from wood fibers, such as bamboo fibers, through a method according to another aspect of the present invention illustrated in FIG. 5, which will be described later.

The blank 200 also comprises an outer section 204 substantially surrounding the core section 202. The outer section 204 can completely surround the core section 202 and comprises a plurality of material strips adhered to each other and to the central core section 202. The material strips include, but are not limited to, wood strips, bamboo strips and/or composite wood-bamboo strips.

The outer section 206 includes a pair of side subsections 206*a* and 206*b*, which are disposed symmetrically relative to the core section 202 and adhered to the front side 212 and the rear side 214 of the core section 202, respectively. For example, the subsections 206*a* and 206*b* are substantially equivalent in terms of configuration and size.

The outer section 206 further includes a pair of top and bottom subsections 206*c* and 206*d*, which are disposed symmetrically relative to the core section 202 and adhered to the top side 216 and bottom side 218 of the core section 202, respectively. For example, the subsections 206*c* and 206*d* are substantially equivalent in terms of configuration and size.

Each of the side subsections 206*a* and 206*b* includes a plurality of material strips 208 stacked and adhered together. The material strips 208 are arranged in a first direction A to be stacked with each other. For example, the first direction is substantially perpendicular to the front and rear sides 212 and 214 of the core 202.

Each of the top and bottom subsections 206*c* and 206*d* also includes a plurality of material strips 210 stacked and adhered together. The material strips 210 are arranged in a second direction B to be stacked with each other. For example, the second direction is substantially perpendicular to the top and bottom sides 216 and 218 of the core 202.

The first direction in which the material strips 208 are arranged is offset from the second direction in which the material strips 210 are arranged. For example, the first direction is substantially perpendicular to the second direction.

As discussed previously, the core section 202 is exclusively made of wood fibers artificially fused together, such as bamboo fibers artificially fused together. The outer section 204 can be made of wood, bamboo or the combination thereof. However, other typical materials known in the art for use in baseball bats are also possible for the outer section 204. For example, both the core section 202 and the outer section 204 are made from bamboo materials.

Figure 5:
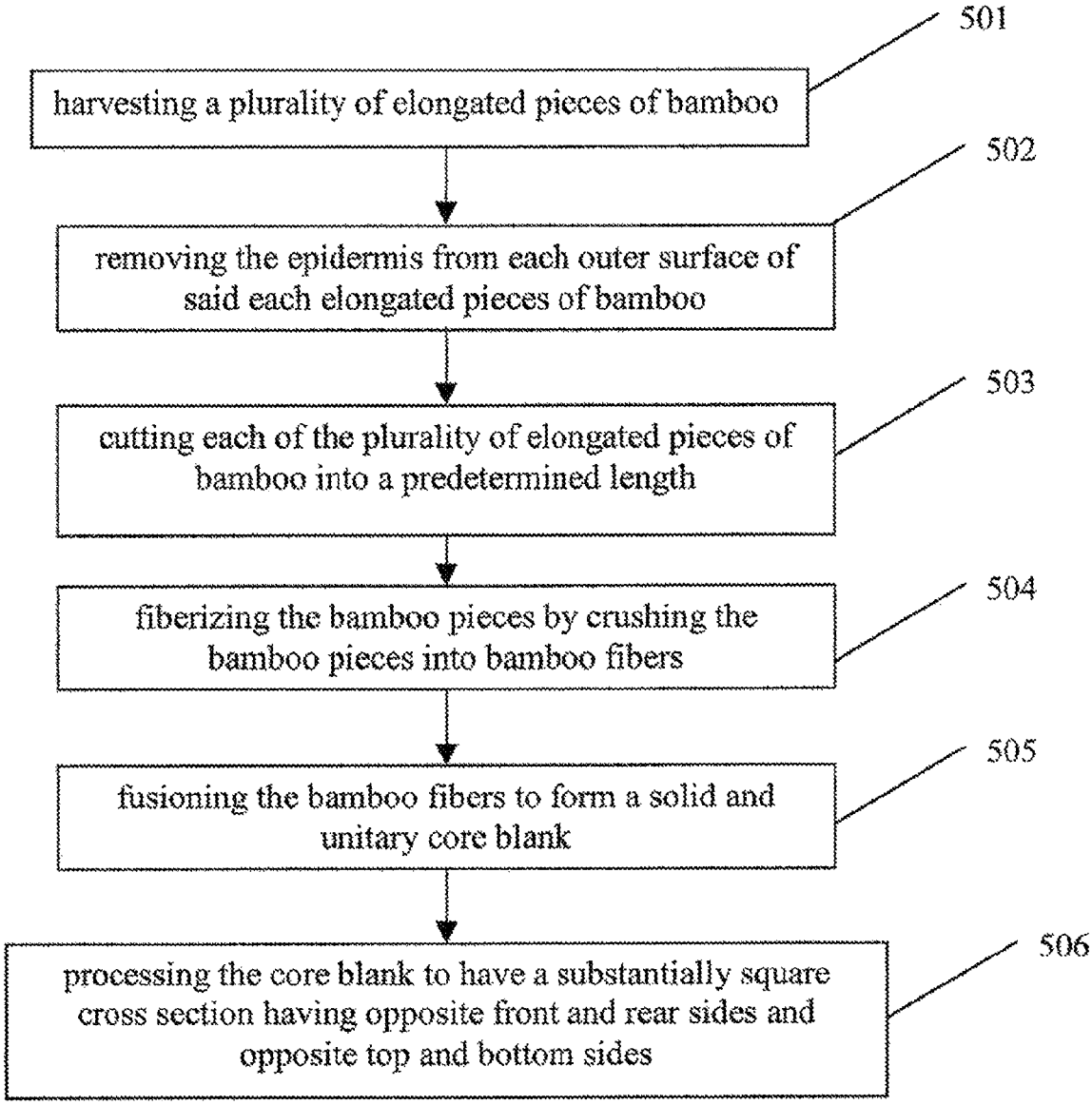
FIG. 5 is a flow chart illustrating a method for manufacturing a core section of the baseball bat of FIG. 3, according to another aspect of the present invention.

Referring to FIG. 5, a method for manufacturing a core section of a baseball bat, such as the core section 202 shown in FIGS. 2A-2C, from a suitable wood is illustrated. The exemplary method will be described in reference to bamboo as a preferred embodiment of the suitable wood. However, a person of ordinary skill in the art understands that the suitable wood, not limited to bamboo, includes a wide variety of wood, such ash maple, ash and so on.

At step 501, a plurality of elongated pieces of wood suitable for fabricating core sections of baseball bats are harvested. For example, the suitable wood can be bamboo harvested when approximately four to five years old and when the diameter of the head of the bamboo is approximately 10-12 cm. After being harvested, the bamboo should be processed as discussed below within three days.

At step 502, the outer layer of the bamboo pieces, such as epidermis or skin, is removed from each elongated bamboo piece. Removal of the epidermis or skins of the bamboo pieces effectively removes the undesirable materials contained by the epidermis or skins, such as chemical agents contributive to the oxidation of the bamboo materials and a non-adhesive wax layer, which counteracts the fusing of bamboo fibers. Removal of the epidermis or skins of the bamboo pieces can be implemented by any traditional approaches and machinery, such as an abrading machine.

At step 503, the elongated bamboo pieces are cut into segments having a predetermined length suitable for fabricating core sections of baseball bats. At this step, the harvested bamboo is cut to sizes depending on the required different lengths for a particular baseball bat being fabricated. In addition, the cutting step 503 may be implemented prior to or after step 502 for removing the epidermis or skin of the bamboo pieces, depending on the operational circumstances and requirements.

At step 504, the bamboo segments are fiberized by, for example, sufficiently crushing the segments into bamboo fibers. For example, the bamboo segments are roughly crushed by a rolling machine and/or further processed by additional machineries, with the result that the bamboo fibers along the growing direction of the bamboo are entirely separated from each other.

Figure 6:
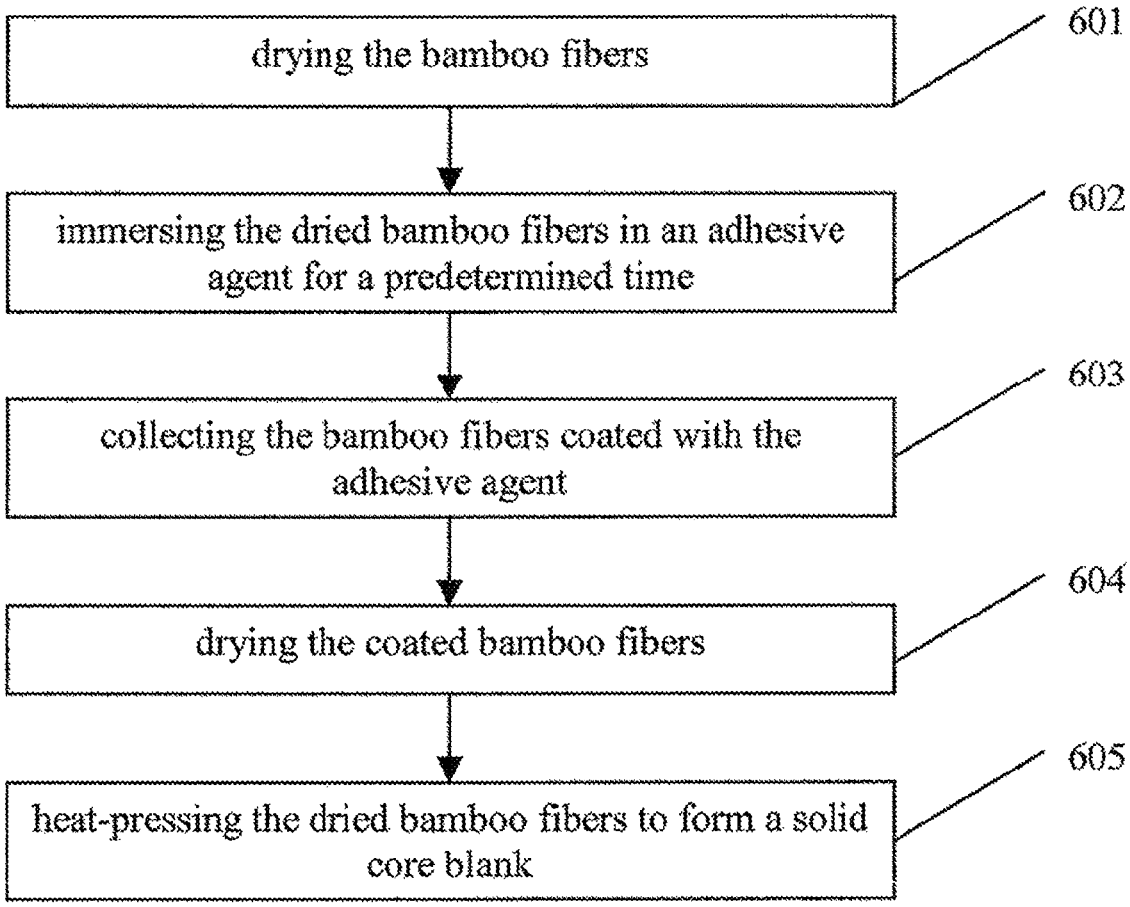
FIG. 6 is a flow chart illustrating one embodiment for implementing fusing wood fibers to form a solid and unitary core blank.

At step 505, the resultant bamboo fibers are artificially fused together to form a solid and unitary core blank. Now referring to FIG. 6, an exemplary embodiment for implementing the fusing step is illustrated. At step 601, the resultant bamboo fibers are dried, for example, in a drying room. For example, the bamboo fibers are dried at 100 degrees Celsius to keep the moisture content of the bamboo fiber at about 10%. At step 602, the dried bamboo fibers are submerged or immersed in an adhesive agent for a predetermined time. At step 603, the bamboo fibers coated or impregnated with the adhesive agent are collected. At step 604, the collected bamboo fibers are subsequently dried. For example, the bamboo fibers coated or impregnated with the adhesive agent are dried at 50 degrees Celsius to keep the moisture content of the bamboo fiber at about 10-15%. At step 605, the dried bamboo fibers coated or impregnated with the adhesive agent are heat-pressing to form a solid and unitary core blank. This step can be implemented by a known Heat Pressure Machine (HPM).

Once the bamboo fibers are artificially fused to provide a solid and unitary core blank, at step 506, the resultant core blank is processed to provide a desirable core section which is subsequently bonded to an outer section to provide a blank for fabricating a baseball bat. At this step, the resultant solid and unitary core blank is processed to have a substantially square cross section. For example, at this step, the resultant solid core blank is processed to a 900 mm×20 mm×20 mm core section made of bamboo fibers, such as the core section 202 illustrated in FIGS. 2A-2C. In addition, the steps 505 and 506 can be combined and implemented simultaneously. For example, the fusing process of the bamboo fibers can be controlled to provide a predetermined shape and profile to the solid and unitary core blank.

Referring back to FIGS. 2A-2C, the blank 200 has a three-layer configuration, with the top subsection 206*c* being the top layer, the core section 202 and the side subsections 206*a* and 206*b* the middle layer, and the bottom subsection 206*d* the bottom layer. During the fabricating process, the top layer, middle layer and the bottom layer are formed separately and subsequently bonded together through, for example, heat-pressing processes.

For example, each of the plurality of material strips 208 of the side subsections 206*a* and 206*b* is processed such that, once they are pressed and adhered together, the resultant side subsections 206*a* and 206*b* have a thickness of around 20 mm. Thus, the side subsections 206*a* and 206*b* can be aligned with the core section 202 to provide a unified middle layer.

In the shown embodiment, the blank 200, having the outer section 204 wound around the core section 202, has dimensions of around 900 mm×70 mm×70 mm.

Figure 3:
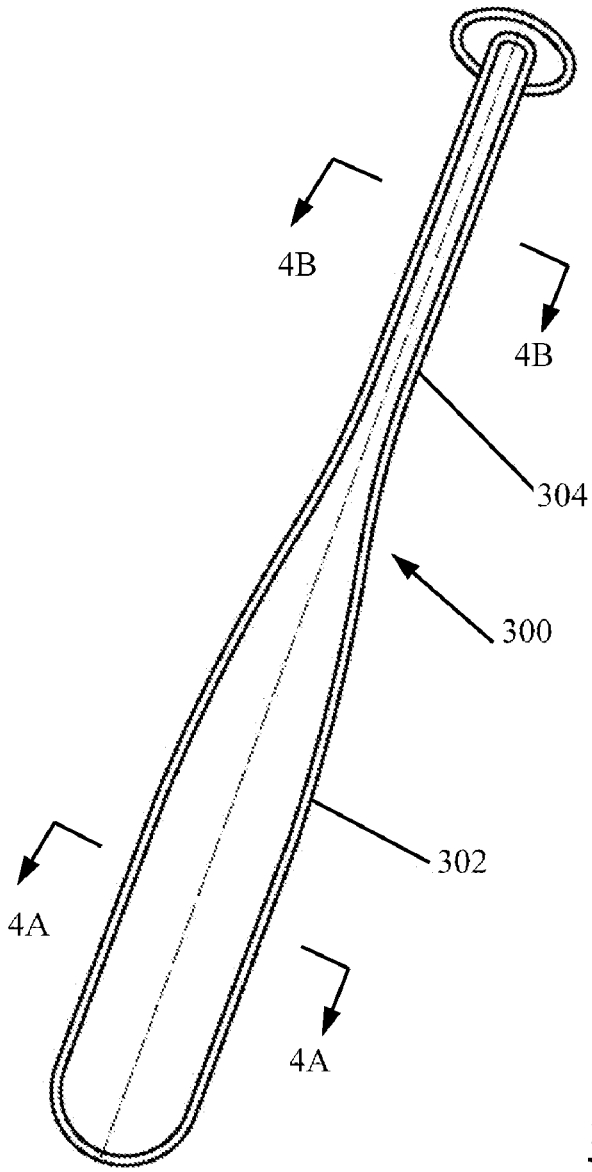
FIG. 3 shows a finished baseball bat manufactured from a blank shown in FIGS. 2A, according to another aspect of the present invention.
Figure 4:
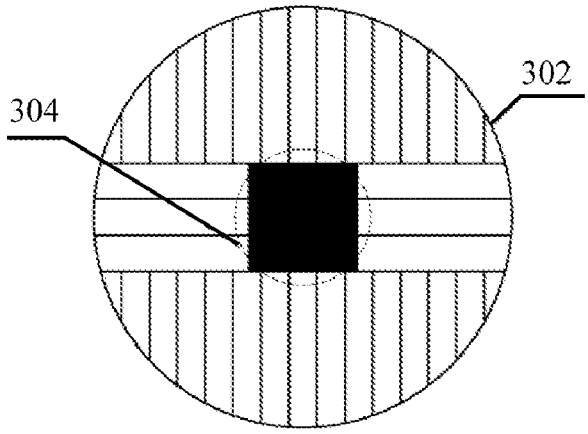
FIG. 4 is a composite sectional view illustrating both a sectional view of the baseball bat of FIG. 3 as taken along lines 4A-4A at the thickest part of the baseball bat and a sectional view of the baseball bat of FIG. 3 as taken along lines 4B-4B at the thinnest part of the baseball bat.

The construction of a finished baseball bat will now be described with reference to FIGS. 3 and 4, the finished baseball bat being referred to generally by reference number 300.

The blank 200 shown in FIGS. 2A-2C is passed between shaping and polishing stations for rough polishing, fine polishing and very fine polishing to craft the blank 200 into the shape of a baseball bat 300. The baseball bat 300 can be shaped such that the core section 202 and at least a portion of the outer section 204 remain in all cross sections of the baseball bat along its length. Typically, the barrel 302 of the bat 300 has the largest cross section while the handle 304 has the smallest cross section. As can be seen in FIG. 4, a large portion of the outer section 204 remains after shaping of the barrel 302 of the bat and a smaller portion of the outer section 204 remains after shaping of the handle 304. Since the core section 202 is surrounded by at least a portion of the outer section 206, the resulting baseball bat 300 will be stronger and less prone to breakage than a bat in which only the core section remains after shaping. Furthermore, the handle 304, mainly constructed by the core 202, has a much higher strength compared with known wood or bamboo bats, due to the solid and unitary core 202 made of bamboo fibers.

After shaping and polishing, the baseball bat 300 is finished, preferably with one or more, and preferably two coats of lacquer paint. However, other finishes, such as stains can also be applied to the baseball bat 300.

Figure 7:
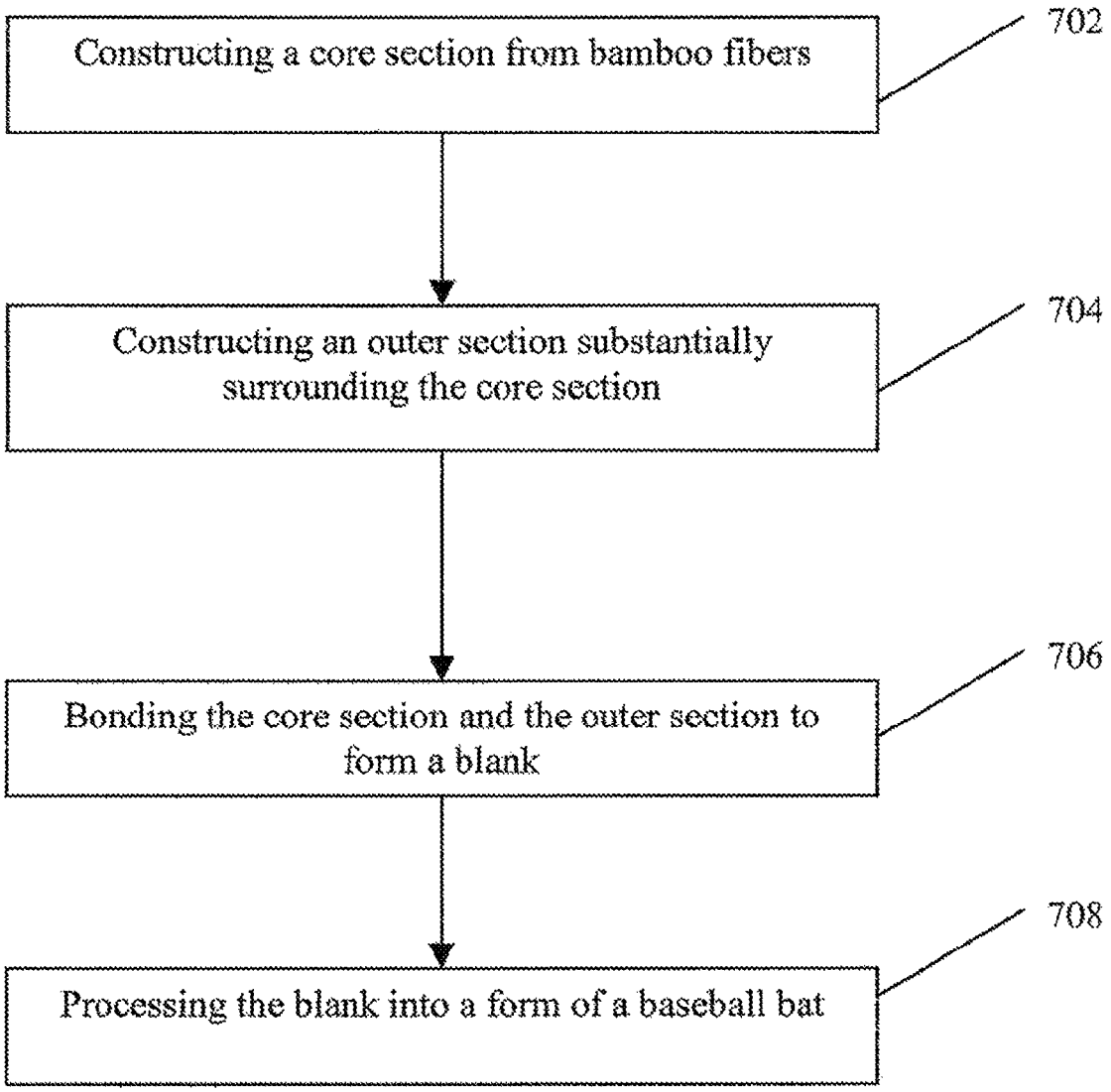
FIG. 7 is flow chart illustrating a method for manufacturing a baseball bat, according to another aspect of the present invention.

FIG. 7 is a flow chart illustrating a method for manufacturing a baseball bat, according to another aspect of the present invention. At step 702, a core section for a baseball bat is fabricated exclusively from bamboo fibers artificially fused together according to the method described in connection with FIG. 5. For example, the core section is formed to have a substantially square cross section having opposite front and rear sides and opposite top and bottom sides.

At step 704, an outer section for a baseball bat is fabricated according to a known method. For example, the outer section is formed to comprise a pair of side subsections and a pair of top and bottom subsections. At step 706, the outer section is bonded to the core section to form a baseball bat blank. For example, the side subsections of the outer section are adhered to the front and rear sides of the solid core blank respectively; the top and bottom subsections of the outer section are adhered to the top and bottom sides of the solid core blank, respectively.

At step 708, the baseball bat blank is shaped into a form of a base bat. The processing preferably comprises shaping the blank into the form of a baseball bat. The processing preferably further comprises polishing the baseball bat resulting from the shaping. The processing also preferably further comprises finishing the baseball bat resulting from the polishing.

The following comparison table illustrates the testing results based on experiments conducted to a Mizuno® bamboo baseball bat accessible in the market, a Quadcore® bamboo baseball accessible in the market, and a bamboo baseball bat according to the present invention.

TABLE 1

| Testing No. | Testing subject | Impact strength (KJ/M2) |
|---|---|---|
| 1 | Mizuno ® Bamboo Bat | 78.8 |
| 2 | Quadcore ® Bamboo Bat | 104.4 |
| 3 | "Fiber-fused Core" Bamboo Bat | 136.7 |

As shown in the table, the bamboo bat having an artificially fiber-fused core, according to the present invention, has exhibited impact strength of around 73% higher than the market accessible Mizuno® bamboo baseball bat and around 31% higher than the market accessible Quadcore® bamboo baseball bat. Currently, sellers of the Mizuno® bamboo baseball bat can offer a warranty of 90 days against breakage, and sellers of the Quadcore® bamboo baseball bat can offer a warranty of 100 days against breakage, which is by far the longest in the market.

Based on the above testing results, the inventors of the present invention has concluded that the "fiber-fused core" bamboo bat can be sold with a warranty against breakage for a significantly longer time, such as one year, which would provide the manufacturers as well as the sellers of the "fiber-fused core" bamboo bat a significant commercial edge in the market place.

Those skilled in the art will appreciate that the dimensions for the core 202, strips 208 and 210, and the overall dimensions of the blank 200 and bat 300 are given by way of example only and not to limit the scope or spirit of the present invention. Those skilled in the art of baseball bat manufacturing will appreciate that bat sizes can differ greatly between bats intended for different age groups and also within any particular age group.

The baseball bats of the present invention enable the bat to have a balanced weight throughout its entire length that not only makes the entire bat practically a "sweet-spot", but also makes the bat less prone to breakage.

The baseball bats of the present invention enable the bat to have a stronger handle than known wood or bamboo bats. The core section formed exclusively of artificially fused bamboo fibers offers a stronger, solid and unitary core running through baseball bat. Furthermore, the three-layer configuration of the baseball bat with a unified core in the center offers excellent symmetricalness of the bats.

In addition, the dimensions of the core made of bamboo fibers are approximate to the dimensions of the handle. Thus, it is easier to evaluate the strength of the handle by evaluating the strength of the core.

The baseball bats of the present invention enable a core having a density of around 2.09 times of ordinary wood core, which effectively improves the hitting performance of the bat.

The baseball bat of the present invention has shown a longer life span, which in turn saves the materials used for manufacturing the bats and protects the environment.

While there has been shown and described what is considered to be preferred embodiments of the invention, it will, of course, be understood that various modifications and changes in form or detail could readily be made without departing from the spirit of the invention. It is therefore intended that the invention be not limited to the exact forms described and illustrated, but should be constructed to cover all modifications that may fall within the scope of the appended claims.

What is claimed is:

1. A baseball bat comprising:

a solid core section consisting of a plurality of bamboo fibers, each of the plurality of fibers having a surrounding adhesive coating; and an outer section substantially surrounding the core section, wherein the core section comprises a substantially square cross section having opposite front and rear sides and opposite top and bottom sides.

2. The baseball bat of claim 1, wherein the outer section comprises a pair of side subsections adhered to the front and rear sides of the core section respectively, each of the side subsections comprising a plurality of material strips adhered to each other and to the core section.

3. The baseball bat of claim 2, wherein the outer section comprises a pair of top and bottom subsections adhered to the top and bottom sides of the core section respectively, each of the top and bottom subsections comprising a plurality of material strips adhered to each other and to the core section.

4. The baseball bat of claim 3, wherein the plurality of material strips of the side subsections are arranged substantially in a first direction and the plurality of material strips of the top and bottom subsections are arranged substantially in a second direction.

5. The baseball bat of claim 4, wherein the first direction is substantially perpendicular to the second direction.

6. A blank from which a baseball bat is manufactured, comprising:

a solid core section consisting of a plurality of bamboo fibers, each of the plurality of bamboo fibers having a surrounding adhesive coating; and an outer section substantially surrounding the core section, wherein the core section comprises a substantially square cross section having opposite front and rear sides and opposite top and bottom sides.

7. The blank of claim 6, wherein the outer section comprises a pair of side subsections adhered to the front and rear sides of the core blank respectively, each of the side subsections comprising a plurality of material strips adhered to each other and to the core section.

8. The blank of claim 7, wherein the outer section comprises a pair of top and bottom subsections adhered to the top and bottom sides of the core blank respectively, each of the top and bottom subsections comprising a plurality of material strips adhered to each other and to the core section.

9. The blank of claim 8, wherein the plurality of material strips of the side subsections are arranged substantially in a first direction and the plurality of material strips of the top and bottom subsections are arranged substantially in a second direction.

10. The blank of claim 9, wherein the first direction is substantially perpendicular to the second direction.

11. A baseball bat comprising:

a core section consisting of a plurality of bamboo fibers and an adhesive disposed between every two adjacent bamboo fibers; and an outer section substantially surrounding the core section, wherein the core section comprises a substantially square cross section having opposite front and rear sides and opposite top and bottom sides.

12. A blank from which a baseball bat is manufactured, comprising:

a core section consisting of a plurality of bamboo fibers and an adhesive disposed between every two adjacent bamboo fibers; and an outer section substantially surrounding the core section, wherein the core section comprises a substantially square cross section having opposite front and rear sides and opposite top and bottom sides.

* * * * *